US012653322B2

(12) United States Patent
Cremeans

(10) Patent No.: US 12,653,322 B2
(45) Date of Patent: Jun. 16, 2026

(54) BED SHEET TENSIONER

(71) Applicant: James Cremeans, Sparks, NV (US)

(72) Inventor: James Cremeans, Sparks, NV (US)

( * ) Notice: Subject to any disclaimer, the term of this patent is extended or adjusted under 35 U.S.C. 154(b) by 370 days.

(21) Appl. No.: 17/896,061

(22) Filed: Aug. 25, 2022

(65) Prior Publication Data

US 2023/0067016 A1 Mar. 2, 2023

Related U.S. Application Data

(60) Provisional application No. 63/237,138, filed on Aug. 26, 2021.

(51) Int. Cl.
*A47C 21/02* (2006.01)

(52) U.S. Cl.
CPC ..... *A47C 21/022* (2013.01)

(58) Field of Classification Search
CPC ..... A47C 21/022; A47C 31/105; A47C 21/00; A47C 21/02; A47C 31/023
USPC ..... 5/485, 497, 498, 417
See application file for complete search history.

(56) References Cited

U.S. PATENT DOCUMENTS 768,119 A 8/1904 Fine
3,606,622 A * 9/1971 Williams ..... A47G 9/0238 5/498
3,862,876 A 1/1975 Graves
3,960,193 A 6/1976 Davis
4,422,195 A * 12/1983 Russo ..... A47G 9/0246 5/497
4,461,049 A * 7/1984 Hammond ..... A47C 21/022 5/498
4,659,144 A * 4/1987 Reese ..... B60J 1/2011 160/370.21
4,716,608 A * 1/1988 Whitfield ..... A47C 21/022 24/72.5
4,736,478 A * 4/1988 Dangerously ..... A47C 27/085 5/497
5,077,847 A * 1/1992 Boyd ..... A47C 27/085 5/688
6,615,837 B1 9/2003 Griesbach, III
6,684,429 B1 * 2/2004 Deering ..... A47C 7/383 5/636
8,875,325 B2 * 11/2014 Sloan ..... A47G 9/02 5/413 R
2002/0116762 A1 8/2002 Mastandrea, Jr.
2006/0024471 A1 2/2006 Cunningham
2015/0020310 A1 1/2015 Guillame
2016/0037944 A1 * 2/2016 Savignano ..... A47G 9/062 5/636
2016/0242559 A1 8/2016 Hui
2020/0245775 A1 * 8/2020 Baker ..... A47G 9/0246

* cited by examiner

*Primary Examiner* — David R Hare
*Assistant Examiner* — George Samuel Gines
(74) *Attorney, Agent, or Firm* — The Law Forge; Frank Ward

(57) ABSTRACT

A Bed Sheet Tensioner Apparatus comprising at least one weight container, wherein said weight container includes at least one pocket, an attachment mechanism wherein said attachment mechanism comprises at least two attachment points, and wherein at least one said attachment point is attached to a sheet and at least one attachment point is attached to said weight container, and at least one weight configured to fit within said pocket of said weight container.

3 Claims, 11 Drawing Sheets

BED SHEET TENSIONER

CROSS REFERENCE TO RELATED APPLICATIONS

This application claims the benefit and priority of U.S. application Ser. No. 63/237,138 filed Aug. 26, 2021.

BACKGROUND OF THE PRESENT INVENTION

This application does not claim priority from another application.

Field of the Invention

The field of bed sheet tensioners and the like.

REFERENCE REGARDING FEDERALLY SPONSORED RESEARCH OR DEVELOPMENT

Not Applicable to this invention.

Background

Currently in the bed sheet, weighted blanket, and home furnishing market there exists a strong need for a simple, inexpensive, and reliable method for keeping bed sheets located and tensioned during use and when not in use.

For many years inventors have tried to create a weighted sheet that is able to provide tension to keep the sheet located and held down over a person.

For example, in U.S. Pat. No. 768,119 (the "119 patent"), in 1904 Mahlon Fine invented a blanket with blanket with weights stitched into the fringe of the blanket. Similarly in 1976, U.S. Pat. No. 386,876 (the "876 patent") issued, which discloses a sheet with a pocket on the fringe of the sheet that is weighted using sand or a similar granular material.

Even more recently, in 2003, U.S. Pat. No. 6,615,837 (the "837 patent") issued, which discloses a surgical drape with a weighted fringe.

However, none of these designs have proven satisfactory. The designs use weighted fringes, requiring a custom sheet with a built-in weight pocket and if the weight or weights are permanently enclosed, then the sheet is very difficult to clean without damaging it. For example, in the '876 patent, the sand or granular material would either wash out during cleaning or become bunched at one end of the pocket. This greatly reduces the usability of the sheet. In addition, most of the fringe weight designs use permanent weights that are not adjustable by the user.

In contrast, the non-woven surgical drape of the '837 patent avoids these problems by having removable weights that are evenly spaced and by being single use. However, being single use, the sheet can only be used once, which fits its intended use of being a surgical accessory.

In other cases, such as the beach towel disclosed in Patent Application US20150020310 (the "310 Application"), the weights are only located in a few locations around the perimeter of the towel, which allows the towel to bunch up or otherwise move in those areas without weights. In addition, a user can only place the weights in those locations and hos no freedom to place the weights in those locations that function best for a particular application.

In addition to just weighting the sheets or blankets, inventors have tried to use hold downs to keep the sheet in place and tensioned. For example, in U.S. Patent Application No. 2016024559 a bar is run inside the fringe of a sheet, which is then latched into a hold down device, which is turn anchored to the bed or floor. Once the bar is latched into place the sheet is held in position. However, this means that the user cannot easily get in or out from under the sheet once it is latched in place because unlike a weight the latch does not allow the sheet to be lifted.

The below described new Bed Sheet Tensioner was conceived and developed to overcome the limitations inherent in the above-described designs.

SUMMARY OF THE INVENTION

The Bed Sheet Tensioner overcomes the above-described limitations by using a mixture of novel features. In one embodiment, the Bed Sheet Tensioner is comprised of two or more weight containers that run the length of the side of a sheet, blanket, or other similar covers (hereinafter referred to as a "sheet"). The weight containers are attached to the sheet using a variety of mechanisms like hooks, fabric loops, stitching, clamps, Velcro, pins and eyelets, or the like. The attachment mechanism can be permanently attached to the weight container or may be removable.

In these and other embodiments, the weight container may be made of fabric, or a similar material, which allows the weight container to be cleaned separately from the sheet.

The weight containers include pockets that allow weights to be placed within the weight container. The pockets are either open or openable, so that the weight in the container can be adjusted by adding or removing weights from the container.

The weights may be made of any suitable material and be of any shape that fits within the pocket of the weight container. Preferably, the weights will be fabric, or plastic, bags filled with sand, plastic or metal beads, or a similar granular material. Solid weights may also be used but are not as preferred because of the danger of injury to a user if a weight is accidently dropped.

In addition, the pockets may also be used to store cell phones, tablets, or anything else a user commonly keeps near the bedside. This adds to the functionality of the weight container, while also allowing the user to adjust the weight as desired. In some embodiments, an additional storage pocket may be added to the weight container, so that a user's belongings do not need to share the same space as a weight.

In other embodiments, multiple, smaller, weight containers can be used on each side of a sheet. Similarly, to the other designs, the weight containers are attached to the sheet using similar attachment mechanisms. Using multiple weight containers allows a user to adjust the weight more easily and adjust where the sheet is tensioned. This gives a user more flexibility in setting the tension for the user's comfort.

In these and other embodiments, the weight containers may wrap slightly around the corners of the sheet to keep the end of the sheet down and over a user's feet.

These designs overcome many of the limitations of previous attempts, because the weight container is removable from the sheet, so any sheet may be used with it, and the sheet may be cleaned as normal.

In addition, the ability to adjust the weight on the sheet allows a user to adjust the tension and comfort level of the sheet to the user's preference. Tensioning the sheet allows a user the benefit of by keeping heat contained within the sheet, which makes it more comfortable during colder weather.

Furthermore, by only weighting two sides of the sheet, the weight is kept balanced. This also keeps the sheet from sliding off the end of the bed, as is common when the third, foot end of the sheet is weighted.

Additionally, the sheet is not weighted where it would cover a user's neck because this can give the user a sensation of being choked, which is not desirable, or comfortable.

In another embodiment, the bed sheet tensioner is comprised of at least one weight container, wherein the weight container includes at least one pocket, an attachment mechanism wherein the attachment mechanism comprises at least two attachment points, and wherein at least one the attachment point is attached to a sheet and at least one attachment point is attached to the weight container, and at least one weight configured to fit within the pocket of the weight container.

In this embodiment, the attachment point on the weight container, is configured to attach to the attachment mechanism, with the attachment point comprising at least one of a group consisting of a Velcro attachment, a loop, a stitched connection, a snap connection, or a button connection.

In addition, the attachment mechanism is comprised of at least one of a group consisting of a clamping mechanism, an eyeloop mechanism, a hook mechanism, snap mechanism, a button mechanism, or a Velcro mechanism.

The weight may be comprised of at least one of a group consisting of a plastic or metallic granular material contained within a flexible container, a naturally occurring granular material contained within a flexible container, or a solid plate or block of plastic or metal.

Additionally, the bed sheet tensioner of any embodiment may be used by obtaining a bed sheet tensioner, attaching the bed sheet tensioner to a sheet using the attachment mechanism to a user defined location on the sheet, and placing one or more of the weights into the weight container until a user desired tension is applied to the sheet by the bed sheet tensioner.

In another possible embodiment, the sheet may include a folded over hem running along two sides of the sheet, with the hem divided into one or more pockets such that removable, modular, weights may be inserted into the pockets. This feature allows the weights to be easily added or removed to the sheet, while the sheet retains all the functionality of normal bedding, such as ease of cleaning and use.

In another embodiment, the Bed Sheet Tensioner may include a sheet, wherein the sheet has at least one edge and a center section bounded by the at least one edge, at least one weight container, wherein the weight container includes at least one pocket, wherein the pocket is created by folding over the at least one edge of the sheet onto the center section of the sheet and is fixedly attached to the sheet in at least one location such that a chamber is created, and at least one weight configured to fit within the pocket of the weight container.

The weight container is fixedly attached using at least one of a group comprising stitching, Velcro, clasps, or buttons As will be obvious to anyone of skill in the art, numerous modifications to the features described are possible. Accordingly, the described and illustrated embodiments are to be construed as merely exemplary of the inventive concepts expressed herein and addressed in the appended claims.

For a better understanding of the invention, its operating advantages and the specific objects attained by its uses, reference should be made to the accompanying drawings and descriptive matter in which there are illustrated preferred embodiments of the invention.

Various objects, features, aspects and advantages of the present embodiment will become more apparent from the following detailed description of embodiments of the design, along with the accompanying drawings.

DESCRIPTION OF THE DRAWINGS

Note: The drawing and figures may be in simplified form and should not be considered to be precisely to scale.

DETAILED DESCRIPTION OF THE INVENTION

The present Bed Sheet Tensioner greatly improves upon current designs in many ways. In the following description, numerous specific details are set forth to provide a more thorough description of embodiments of the Bed Sheet Tensioner. It will be apparent, however, to one skilled in the art, that the embodiments of the Bed Sheet Tensioner may be practiced without these specific details. In other instances, well known features have not been described in detail so as not to obscure the many benefits of the Bed Sheet Tensioner. In all instances, it should be expressly understood that the embodiments illustrated herein are merely exemplary of the inventive concepts expressed and that many alterations and modifications may be made by those having ordinary skill in the art without departing from the spirit and scope of the embodiments.

Figure 1:
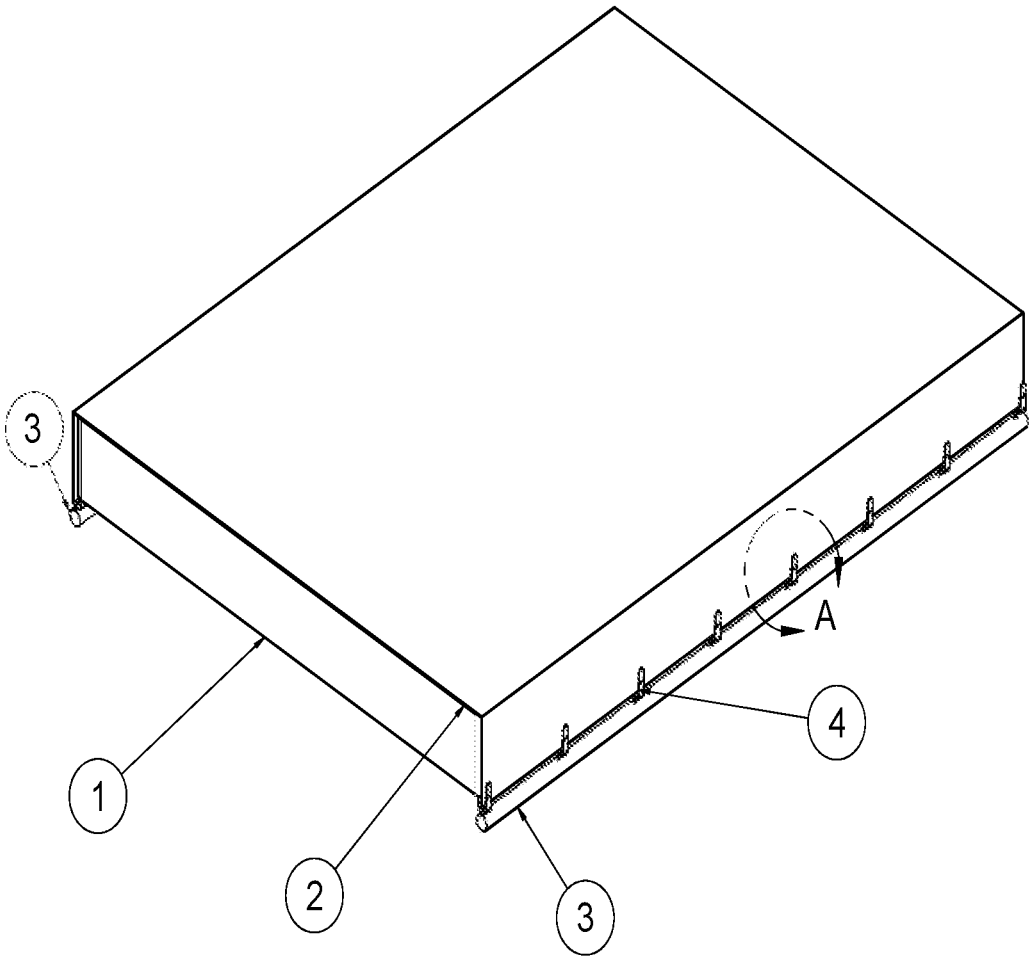
FIG. 1 is an isometric view of one embodiment of the Bed Sheet Tensioner.
Figure 2:
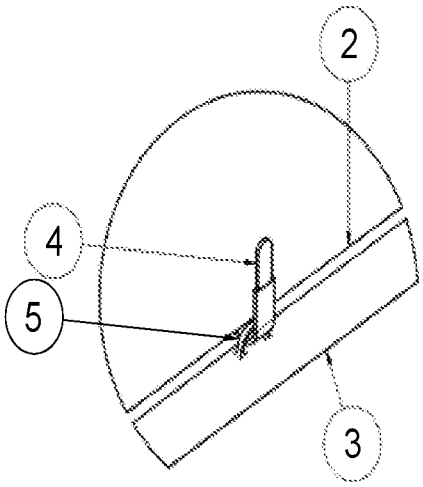
FIG. 2 is an enlarged view of one embodiment of an attachment mechanism consisting of a hook.

Referring first to FIGS. 1 and 2, and one possible embodiment of the Bed Sheet Tensioner, a bed 1 is covered using a sheet 2 that is attached to a weight container 3 on each side of the sheet 2. The weight container 3 is attached to the sheet 2 using a loop 5 attached to the weight container 3, which is placed over a hook 4 that is attached to the sheet 2. Though not shown, the hook 4 may be attached to the sheet 2 in multiple ways including, adhesives, stitched connections, Velcro, clamps, or pins and eyelets. In addition, in this embodiment the weight container 3 is tubular and container one large interior passageway for weights.

By running the length of the sheet 2, the weight container 3 creates uniform tension along the sheet. Also, by using two weight containers the tension can be uniform across the top of the sheet 2. To adjust the amount of tension on the sheet 2, a user simply changes the amount of weight in the weight container 3.

In addition, in this embodiment the attachment hooks 4 are evenly spaced to help create an even distribution of weight along the sheet 2. However, the number and placement of the hooks 4 can be varied to create the ideal amount of tension desired by the user. This flexibility is an integral part of the invention and improves its performance greatly compared to other designs.

Figure 3:
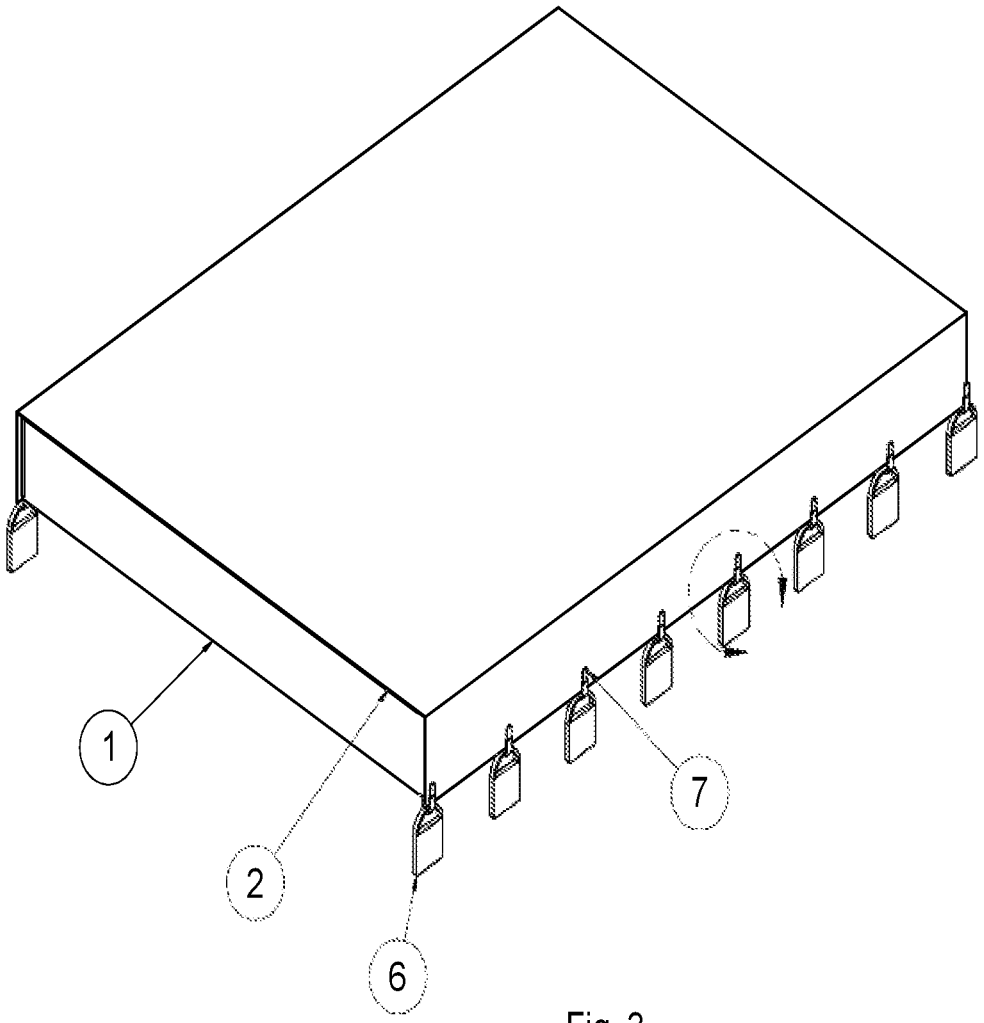
FIG. 3 is an isometric view of one embodiment of the Bed Sheet Tensioner.
Figure 4:
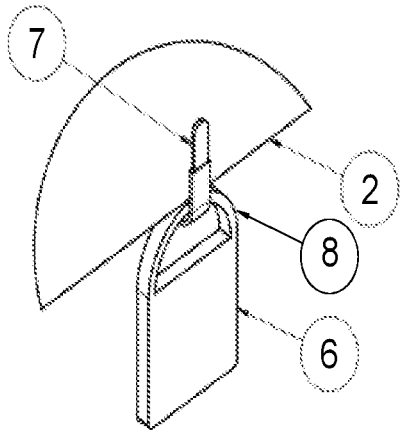
FIG. 4 is an enlarged view of one embodiment of an attachment mechanism.

Turning next to FIGS. 3 and 4, and another possible embodiment of the Bed Sheet Tensioner, a bed 1 is covered by a sheet 2. In this embodiment, multiple weight containers 6 are attached to two sides of the sheet 2 using multiple hooks 7. The hooks 7 are attached to the sheet 2 on one end and on the other hook through a loop 8 on the weight container 6.

The weight containers 6 are distributed along the length of two sides of the sheet 2 to create an even distribution of tension across the sheet 2. However, if a user desires more tension in one area of the sheet 2, then the weight containers 6 may be clustered in one area to increase the tension there or removed from areas where tension is not desired.

Figure 5:
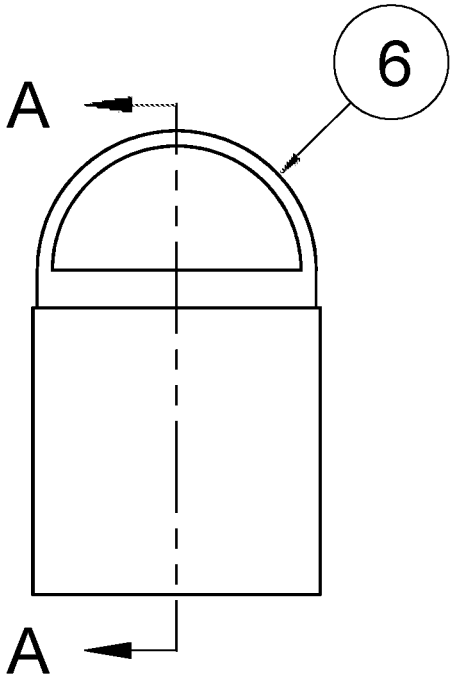
FIG. 5 is a front view of an embodiment of a weight container.
Figure 6:
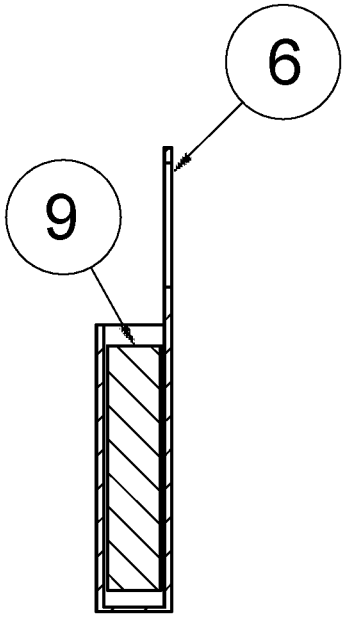
FIG. 6 is a section view of an embodiment of a weight container.

As viewed in FIGS. 5 and 6, each weight container 6 includes a pocket into which a weight 9 can be placed. In this embodiment, a single weight 9 is shown placed in each weight container 6. However, though not shown, several smaller weights may be placed in the pocket on each weight container 6. In addition, the weight pocket may also be used to store a user's personal belongings.

Figure 7:
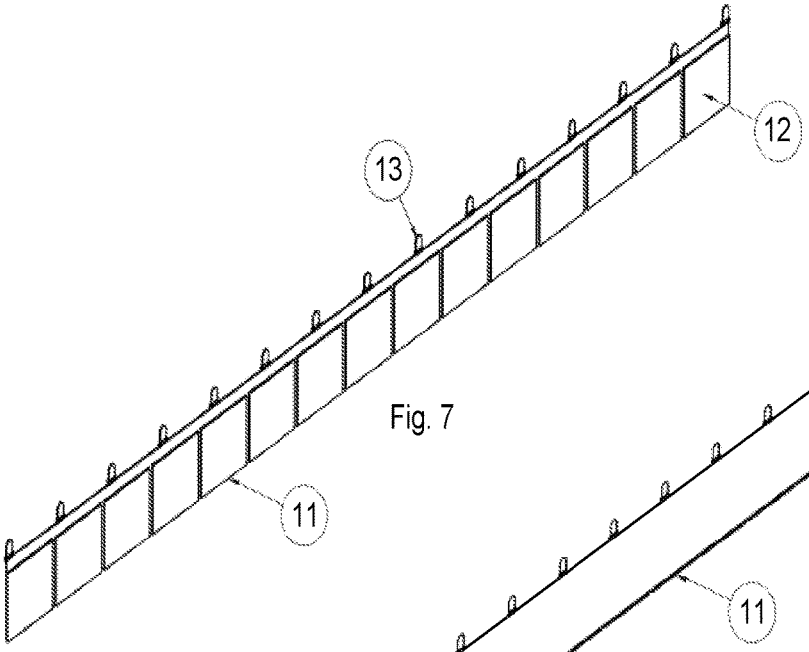
FIG. 7 is an isometric front view of an embodiment of a weight container.
Figure 8:
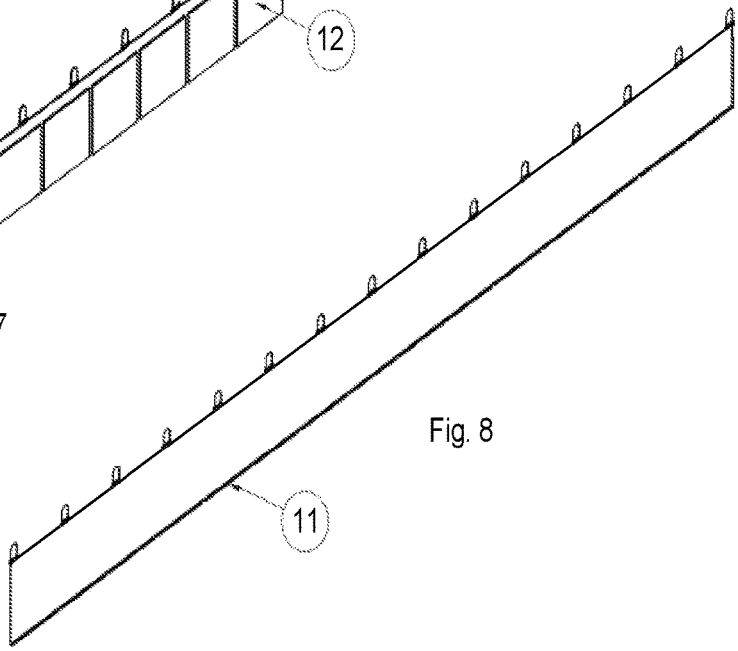
FIG. 8 is an isometric back view of an embodiment of a weight container.

Turning next to FIGS. 7 and 8, which show another embodiment of a weight container 11 that includes multiple weight pockets 12. This embodiment also includes multiple loops 13 that may be used to attach the weight container 11 to a sheet. By running the length of the bed sheet, this weight container 11 allows the weight to be spread evenly down the side of a sheet. It also allows a user to load sections of the weight container 11 by placing weights in weight pockets 12 in just one section of the weight container 11. Doing so will increase the tension in just a section of a sheet, if so desired by a user. For example, this is particularly useful if the user desires more tension over their feet to keep heat in but does not want their arms constricted.

Furthermore, in this embodiment the weight pockets 12 may also be used as storage for user belongings.

Figure 9:
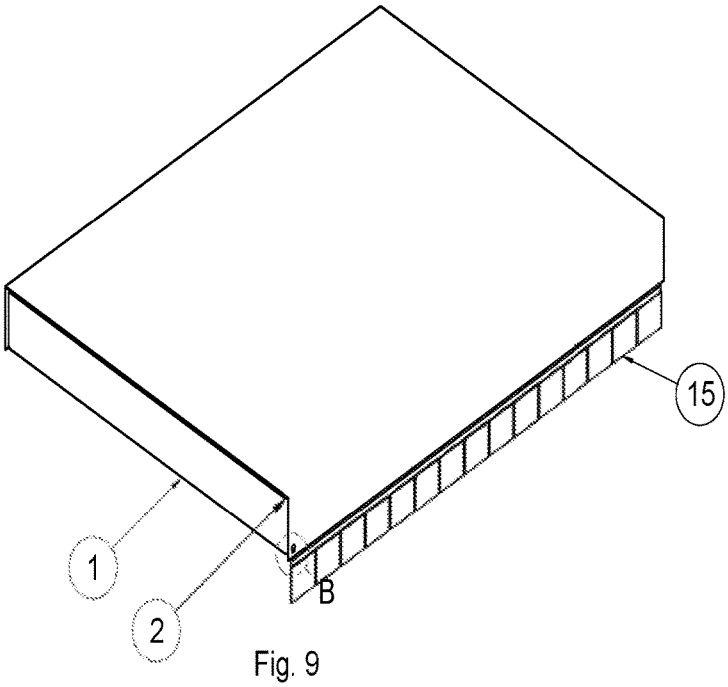
FIG. 9 is an isometric view of one embodiment of the Bed Sheet Tensioner.
Figure 10:
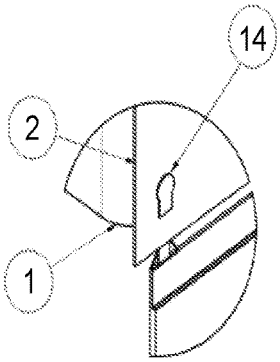
FIG. 10 is an enlarged view of one embodiment of an attachment mechanism consisting of an eyeloop.
Figure 13:
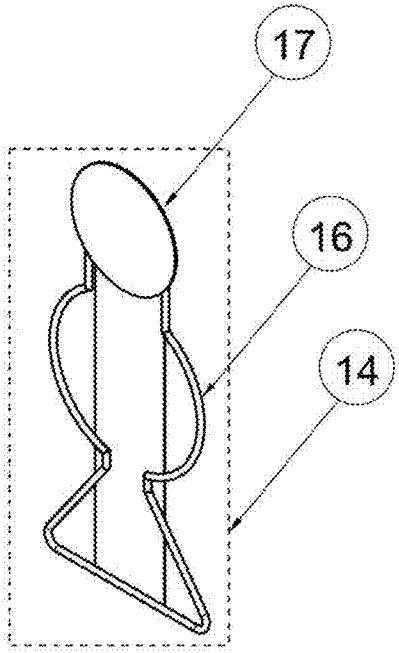
FIG. 13 is an isometric view of the eyeloop.
Figure 12:
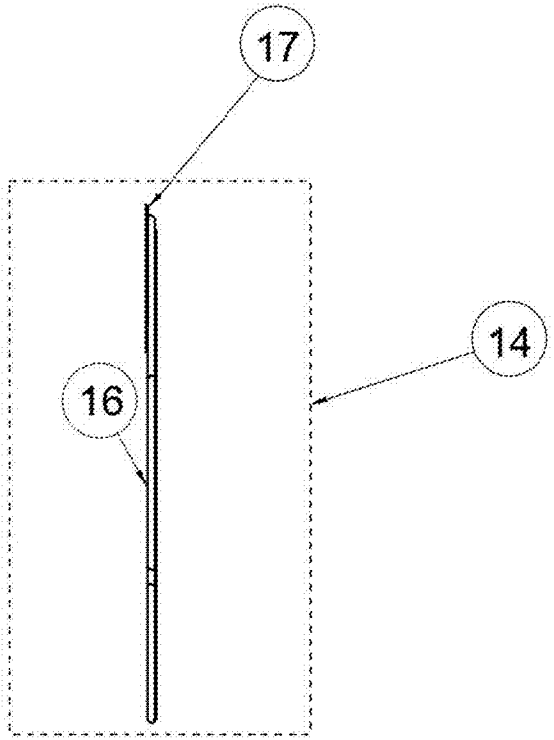
FIG. 12 is a side view of the eyeloop.
Figure 11:
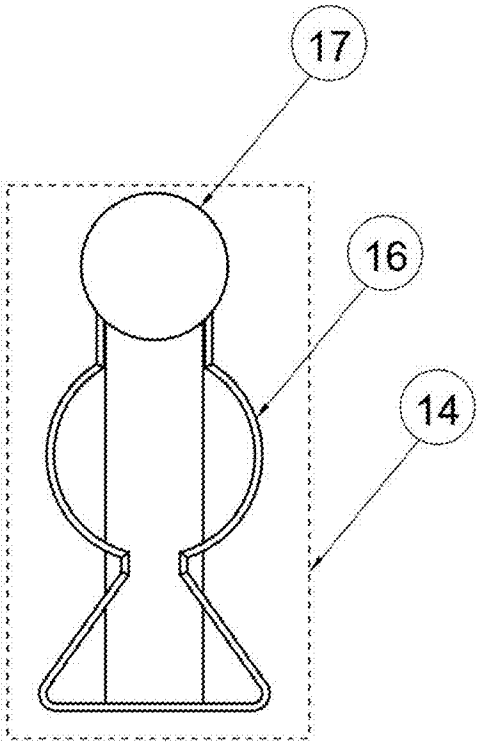
FIG. 11 is a front view of the eyeloop.
Figure 14:
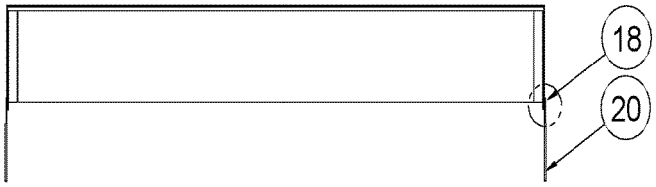
FIG. 14 is a side view of one embodiment of the Bed Sheet Tensioner.
Figure 15:
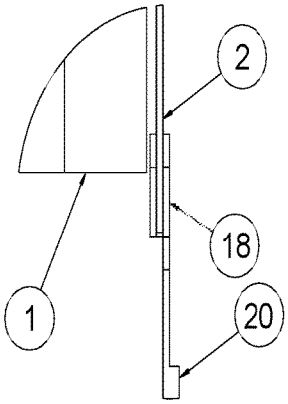
FIG. 15 is an enlarged side view of a clamp and loop attachment mechanism.
Figure 16:
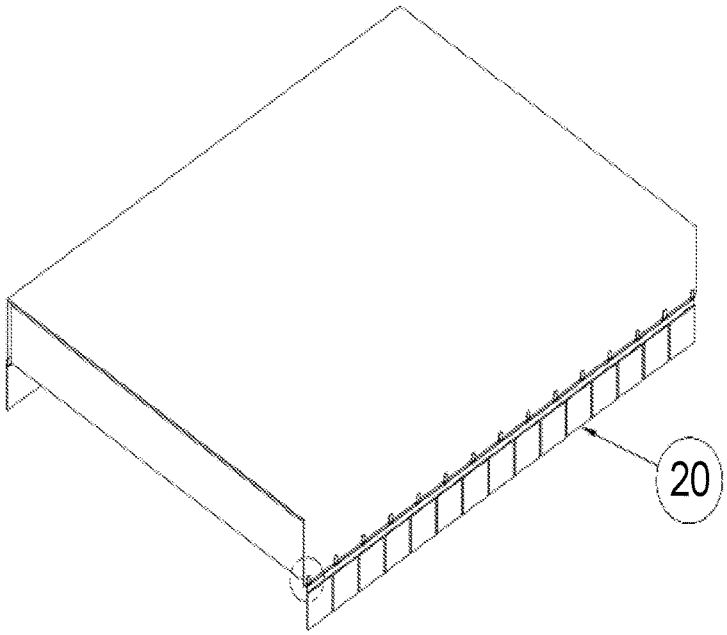
FIG. 16 is an isometric view of one embodiment of the Bed Sheet Tensioner.
Figure 17:
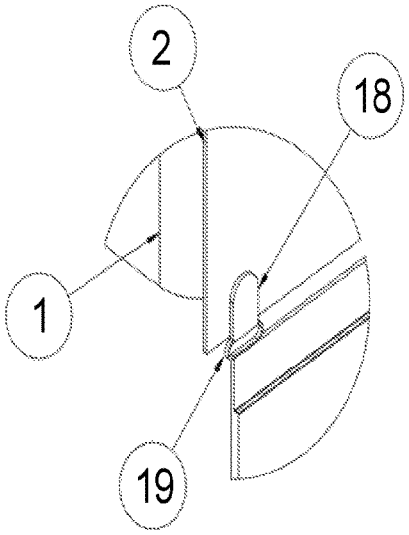
FIG. 17 is an enlarged isometric view of a clamp and loop attachment mechanism.

FIGS. 9 and 10 illustrate another possible embodiment of the bed sheet tensioner using an eyeloop 14 to attach the weight container 15 to the sheet 2. As shown in FIGS. 11 to 13, the eyeloop 14 consists of two pieces: a lock wire 16 that is formed into an almost keyhole shape with a large center hole that necks down to a narrower upper section. A tab 17 with a circular face offset from the body of the tab comprises the second piece of the assembly and the circular face has a narrow neck connecting it to the tab 17. The neck is narrow enough to fit into the narrow upper section of the lock wire 16. To engage the eyeloop 14, a sheet 2 is placed over the tab 17, which is then pushed against the sheet such that the sheet 2 conforms to the shape of the tab 17. The lock wire is then placed over the tab 17 and sheet 2 from the sheet 2 side, so that the sheet is captured between the lock wire 16 and the face of the tab 17. Once the lock wire 16 is over the face of the tab 17, the neck of the tab 17 is forced into the narrow section of the lock wire 16 so that the face of the tab 17 cannot pull through the openings on the lock wire 16. Either the tab 17 or the lock wire 16 can be attached to the weight container 15, though in this particular embodiment the lock wire 16 is attached to the weight container 15 on one end.

By using this attachment mechanism, the weight container 15 can be attached to any sheet 2, which is very convenient for a user because they can quickly and easily remove the weight container to launder or dispose of the sheet 2.

Alternatively, the sheet 2 may be attached to a weight container 20 using a clamping mechanism, like the one illustrated in FIGS. 14 to 17. In this embodiment, the clamp 18 is attached on one end to the weight container 20, shown here as a loop connection, and the clamping section of the clamp is clamped to the sheet 2. This attachment mechanism allows the user to quickly attach the weight container 20 to any sheet 2 and just as quickly remove it for cleaning.

In these and other embodiments, the weight containers may be attached in a variety of ways not illustrated here. In particular, the weight containers may be attached by stitching an edge of a weight container to the sheet. The stitched sections of both the weight container and sheet may be reinforced to increase the strength of the stitched connection. This allows the user to place more tension on the sheet without the danger of the sheet or weight container ripping or tearing. The reinforcement section may be integral to the sheet or weight container, or may be a separate piece.

Figure 18:
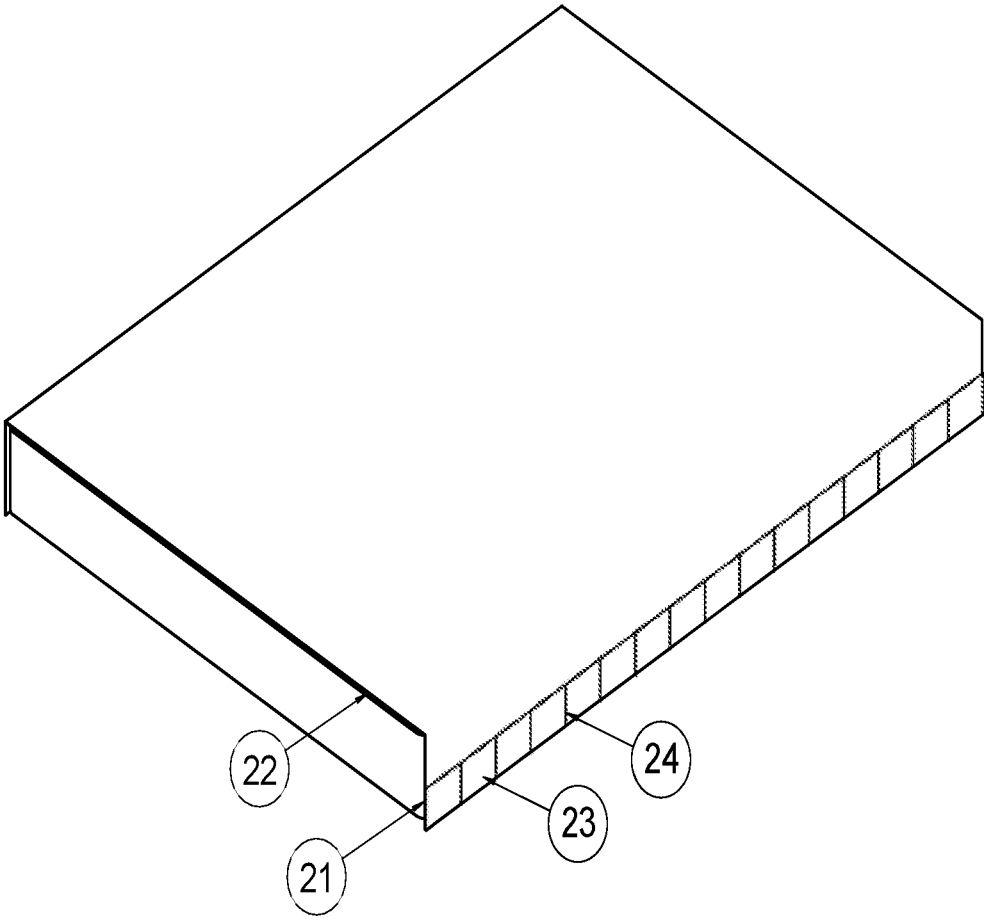
FIG. 18 is an isometric view of one embodiment of the Bed Sheet Tensioner with integral weight containers.

In another embodiment, illustrated in FIG. 18, the weight container 21 may be integrated directly into a sheet 22 by creating a weight container 21 from the edge of the sheet 22 by folding the fabric over onto the sheet and securing it to the body of the sheet using an attachment mechanism 24. The fabric may be secured using stitching, Velcro, buttons, clasps, or other similar attachment mechanisms.

In addition, the weight container 21 may contain one or more pockets 23, as desired by the user, with each pocket 23 being capable of containing one or more modular removable weights. In addition, the weight containers may be created on one or more of the edges of the sheet and is configurable to a user's desired specifications.

In addition to quickly allowing a user to attach a weight container, these attachment mechanisms allow the user to attach the weight container to the sheet in any position along the sheet. Furthermore, these attachment mechanisms are not just limited to attaching the weight container to the edge of a sheet. Instead, they can be used to attach a weight container to any portion of a sheet that can be fitted to the mechanisms. These features maximize the utility of the design by making it extremely versatile.

Numerous modifications to the features described and shown are possible. Accordingly, the described and illustrated embodiments are to be construed as merely exemplary of the inventive concepts expressed herein and addressed in the appended claims.

What is claimed is:

1. A Bed Sheet Tensioner comprising:

a sheet, wherein said sheet has at least four edges and a center section bounded by said at least four edges, wherein two of said at least four edges are parallel and when in use by a user are parallel to a left side and a right side of said user;

at least one weight container, wherein said weight container includes at least one pocket, wherein said at least one pocket runs at least a quarter of the length of said sheet parallel to two of said four edges parallel to said left side and said right side of said user, is created by folding over said at least one edge of said sheet onto said center section of said sheet and is fixedly attached to said sheet in at least one location such that a chamber is created, wherein said fixedly attachment permits positional adjustment of said weight container along said sheet;

at least one weight configured to fit within said pocket of said weight container, and wherein said at least one weight is operable to hold said sheet in place on a user, with an even distribution of weight across the user, and the amount of weight is user adjustable wherein said at least one weight is removable from said pocket.

2. The Bed Sheet Tensioner according to claim 1, further comprising:

said weight comprising at least one of a group consisting of a plastic or metallic granular material contained within a flexible container, a naturally occurring granular material contained within a flexible container, or a solid plate or block of plastic or metal.

3. The Bed Sheet Tensioner according to claim 1, further comprising:

said fixedly attachment is at least one of a group comprising stitching, hook and loop, clasps, or buttons.

* * * * *